United States Patent [19]

Mott

[11] 4,284,141

[45] Aug. 18, 1981

[54] SUBSURFACE WELL APPARATUS AND METHOD

[75] Inventor: James D. Mott, Houston, Tex.

[73] Assignee: Hydril Company, Los Angeles, Calif.

[21] Appl. No.: 368,840

[22] Filed: Jun. 11, 1973

Related U.S. Application Data

[62] Division of Ser. No. 131,629, Apr. 6, 1971, Pat. No. 3,762,471.

[51] Int. Cl.[3] ..... E21B 23/00; E21B 43/00

[52] U.S. Cl. ..... 166/315; 166/322

[58] Field of Search ..... 166/322, 315, 153, 155, 166/156

[56] References Cited

U.S. PATENT DOCUMENTS

| | | | |
|---|---|---|---|
| 3,378,080 | 4/1968 | Fredd | 166/156 |
| 3,477,507 | 11/1969 | Page, Jr. | 166/322 |
| 3,603,394 | 9/1971 | Raulius | 166/322 |
| 3,763,932 | 10/1973 | Dinning | 166/322 |

*Primary Examiner*—James A. Leppink

*Attorney, Agent, or Firm*—Pravel, Gambrell, Hewitt, Kirk, Kimball & Dodge

[57] ABSTRACT

Subsurface well apparatus and method of operating same, wherein a controlled ball valve or closure means is provided, with means for mounting same in a well tubing for normally opening and closing flow through the well tubing, and wherein a fluid flow control assembly having a replacement ball valve therewith is adapted to be dropped in or otherwise lowered through the well tubing so as to position same above said controlled ball valve for subsequent operation of said replacement valve to thereafter serve as a replacement for said controlled valve.

8 Claims, 22 Drawing Figures

23
40f
22
81
80
40h
40g
63j
80a
63f
63k
81d
40i
63c
81b
63d
63
63h
63m
75e
75d
75
75c
75a
75b
64g
63n
63i
63a
64
81a
80c
40
80b
40ja
35
71
70c
40jb
70
64i
61
64h
64a
81c
81e
40k
30b
40m
30f
30
30c 30c
40m
64
40n
64a
40o
64c
65d
65m
65e
65f
65b
65n
30
65
65a
40q
65g
40p
65h
65o
65i
40r
52
65j
50
65k
55a
55
51
52a
53
67c
67f
66h
67e
40s
62
67b
66g
66
67
67d
66e
66b
66f
40
66a
67a
40t
66c
40u
40v
30g
40w
30d
32

23
22
81
80
81a
63k
81b
81d
80a
63e
63d
75
63m
64b
63
63a
64a
80b
80c
71b
70c
70d
71a
70e
71c
71d
70b
70
70a
70f
64
81d
81c
30b
30c 40m
64f
64
40n
64t
64n
64b
64m
65c
64k
64o
64q
65n
64p
64s
65a
65
55
55a
52
55a
40s
51
62
67f
50
52a
67
66
30c
40
61
67a
66a
40t
30g
30d

SUBSURFACE WELL APPARATUS AND METHOD

CROSS-REFERENCES TO RELATED APPLICATIONS

This application is related to my co-pending U.S. patent application, Ser. No. 72,034, filed Sept. 14, 1970. This is a division of application Ser. No. 131,629, filed Apr. 6, 1971, and now U.S. Pat. No. 3,762,471.

BACKGROUND OF THE INVENTION

The field of this invention is a subsurface well apparatus and method.

The practice of using controlled subsurface devices in production tubing of producing wells to close the bore of the production tubing to flow for preventing a well blowout is well known in the art. Sand and other abrasives flowing through the devices with the produced hydrocarbons eroded or damaged the device and frequently made the device inoperative. Previously it has been necessary to utilize a wire line tool or pull a portion of the production string to replace a controlled subsurface device. The lost production as well as the cost of the special crews and equipment made replacement an expensive operation.

SUMMARY OF THE INVENTION

This invention relates to a new and improved pressure operated subsurface well apparatus and method. The apparatus includes a housing having a bore therein connected in a production tubing, a closure means movable to an open position by a first control fluid pressure and which is moved by a means for imparting movement to a closed position when the control fluid pressure is reduced, and a positioning means for positioning a means for controlling flow in the bore when the closure member malfunctions. A ball type closure means for rotating to and from the open and closed position is provided. The means for imparting movement to the closure means includes an equalizing flow means for equalizing the pressure in the bore before commencing to open the closure means and a compound motion means for reducing the pressure of the control fluid needed to move the closure means. The positioning means is movable into the bore of the housing to constrict the bore by a second control fluid pressure. The second control fluid pressure also moves the closure means to the open position and operates a releasable locking means to lock the closure means in the open position. The means for controlling flow in the bore comprises a flow control assembly, a plug means, a plug mover means, a releasable securing means operated by pressure in the bore of the tubing for securing the assembly in the bore of the housing and a means for operably engaging the plug mover means with the means for imparting movement to the closure means. The plug means is moved to the open position by control fluid pressure moving the means for imparting movement and enabling the plug mover means to move the plug means to the open position and which is moved to the closed position when the pressure is reduced by the engaged means for imparting movement moving the plug mover means. The plug means includes a ball type member to and from open and closed positions and having a diameter equal to the diameter of the bore of the housing. The recuring means includes a releasable detent moving into a recess in the surface of the bore of the housing. The means for operably engaging the plug mover means includes a releasable detent moving into a recess in the surface of the bore of the housing adjacent the means for imparting movement. A running and retrieval tool moving and operated by pressure in the bore is used for securing and releasing the means for controlling the flow in the bore.

The method of installing the means for controlling the flow in the bore includes releasably connecting the means for controlling the flow with the running tool, inserting the connected assembly in the bore and increasing the pressure in the bore above the tool. Formation pressure is used to recover the tool.

The method of recovering the means for controlling the flow in the bore includes inserting a retrieval tool in the bore and increasing the pressure in the bore above the tool. After the tool connects with the means for controlling flow in the bore, formation pressure is used to flow the connected assembly back to the surface.

An object of the present invention is to provide a new and improved subsurface well apparatus.

Another object of the present invention is to provide a new and improved subsurface well method.

It is another object of the present invention to provide a new and improved subsurface well apparatus having a bore closure means controlled from the surface.

A further object of the present invention is to provide a new and improved subsurface apparatus having a positioning means for locating a flow control assembly in the bore of the well tool for controlling the flow in the bore.

A further object of the present invention is to provide a new and improved means for controlling the operation of the flow control assembly within the subsurface well apparatus.

Yet still another object of the present invention is to provide a new and improved method for securing a flow control assembly in the subsurface well apparatus.

Another object is to provide a new and improved method for retrieving the flow control assembly from the subsurface well apparatus.

DESCRIPTION OF THE PREFERRED EMBODIMENT

Figure 1:
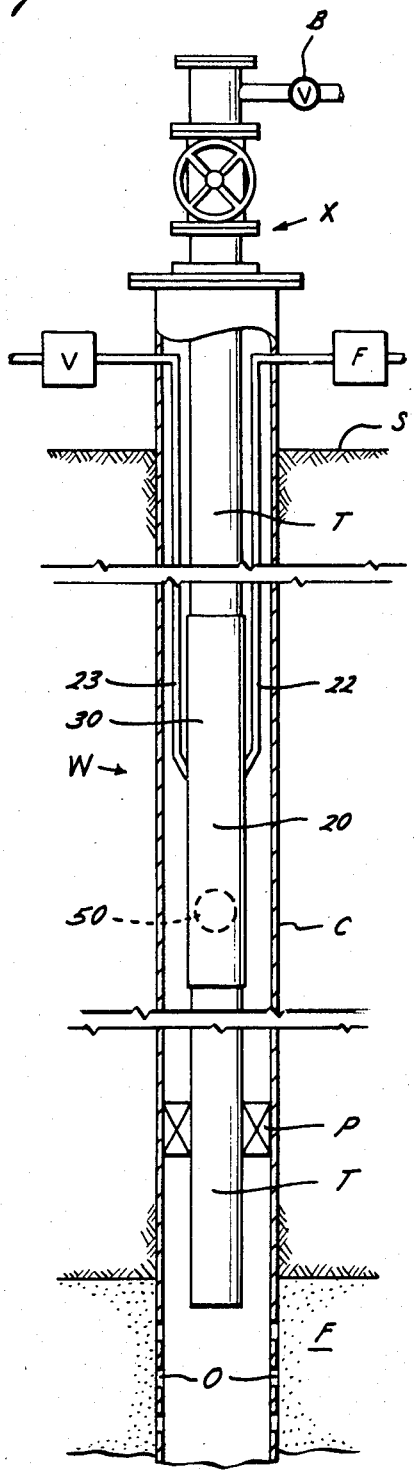
FIG. 1 is an elevation, partly in section, of the apparatus of the present invention connected in a production tubing in a well.

As illustrated in FIG. 1, the subsurface safety valve apparatus or well tool generally designated 20 is mounted in a production tubing T of a well W for controlling the flow of fluid to the surface S through the bore of the production tubing T. A packer P seals the annular space between the outer surface of the production tubing T and the inner surface of the well casing C for forcing the hydrocarbon production through the bore of the production tubing T as is well known in the art. Production flow is from a well formation F through the perforated openings O into the casing C and upward through the bore of the production tubing T to the surface S as is well known in the art. A block valve B connected with a Christmas tree X at the surface S is normally used to control the flow of fluid through the bore of the production tubing T as is well known in the art. A fluid conduit 22 connects the well tool 20 with a control fluid means reservoir F located at the surface S. A conduit 23 connects another portion of the tool 20 with a second control fluid means reservoir V located at the surface S.

Figure 2A:
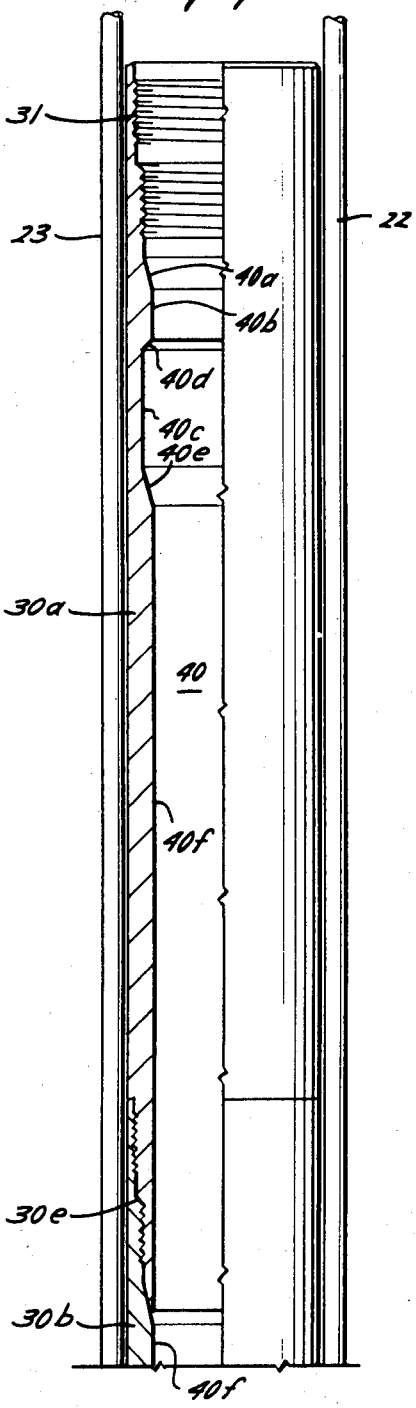
FIGS. 2A, 2B and 2C are elevations, partly in section, from the upper to the lower end, respectively, of the apparatus of the present invention, with the stopper member or ball valve in the closed position.
Figure 2B:
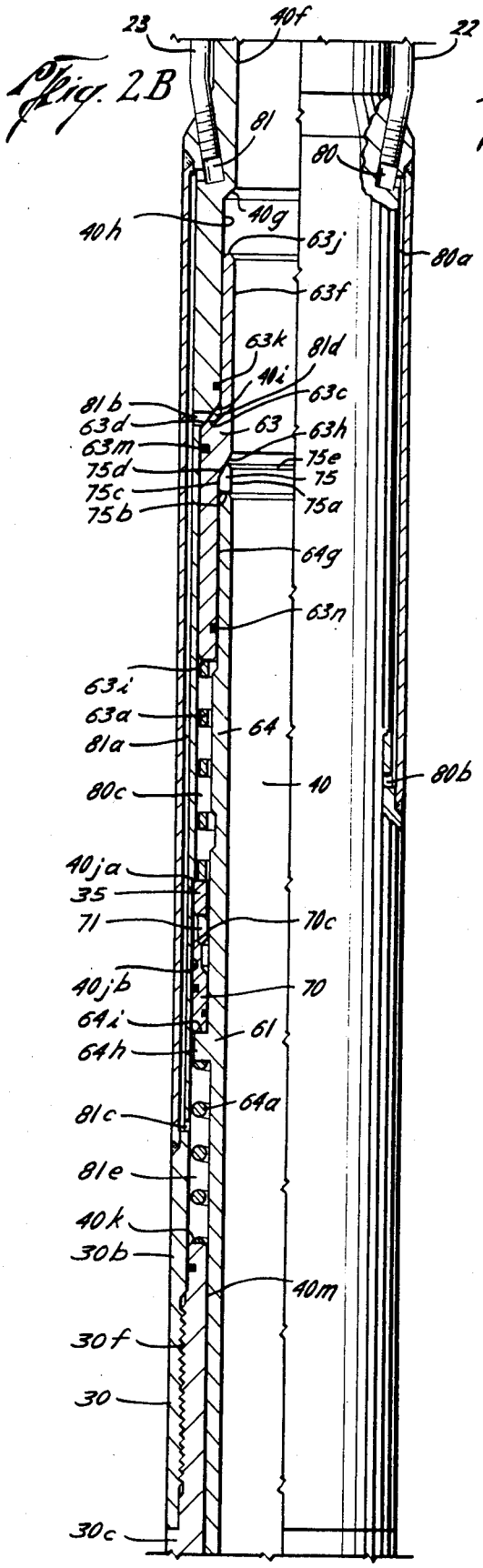
Figure 2C:
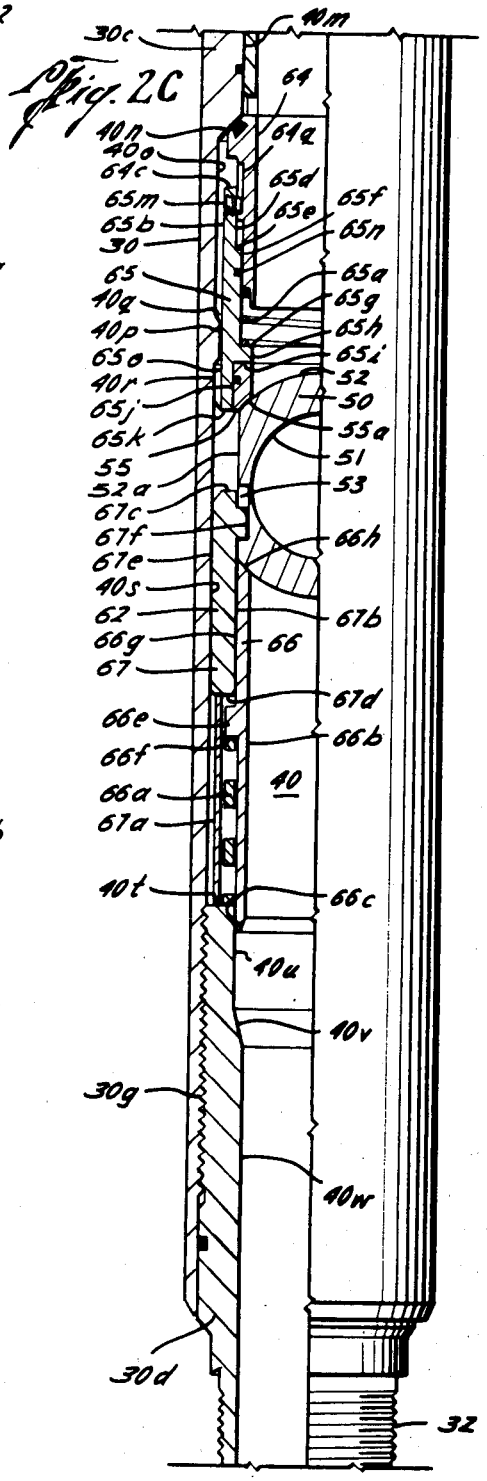

As illustrated in particular in FIGS. 2A, 2B and 2C, the tool 20 of the present invention includes a housing 30, preferably made of four portions 30*a*, 30*b*, 30*c* and 30*d* for purposes of assembly. To assist in understanding the present invention, the Figs. are designated in alphabetical sequence commencing from the upper portion 30*a* of the housing 30 and proceeding downwardly. The upper section 30*a* of the housing 30 is connected to the section 30*b* by threads 30*e*, as illustrated in FIG. 2A. The section 30*b* and the section 30*c* are connected by threads 30*f*, as illustrated in FIG. 2B. The section 30*c* is connected to the section 30*d* by threads 30*g*, as illustrated in FIG. 2C. A threaded box connection 31 at the upper end of the section 30*a* of the housing 30 connects with the production tubing T above the tool 20 (FIG. 1). A threaded pin connection 32 at the lower end of the section 30*d* connects with the production tubing T below the tool 20 (FIG. 1).

The housing 30 is a tubular member having a longitudinal bore 40 aligned and communicating with the inner bore of the production tubing T for enabling flow of fluid through the bore 40 of the housing 30 to the surface S. As illustrated in FIGS. 2A, 2B and 2C, the inner bore is defined in greater detail by a surface including a tapered annular shoulder 40*a*, a constant diameter portion 40*b*, a greater diameter recess 40*c* having tapered annular shoulders 40*d* and 40*e*, a constant diameter portion 40*f*, an annular shoulder 40*g*, a larger constant diameter portion 40*h*, a tapered annular shoulder 40*i*, a constant diameter portion 40*j*, a keeper shoulder 40*ja*, a keeper slide surface 40*jb*, a spring shoulder 40*k*, a constant diameter portion 40*m*, a tapered annular sealing shoulder 40*n*, a constant diameter portion 40*o*, a smaller constant diameter lug or spline portion 40*p* having tapered annular shoulders 40*q* and 40*r*, a constant diameter portion 40*s*, a spring shoulder 40*t*, a constant diameter portion 40*u*, a tapered annular portion 40*v*, and a constant diameter portion 40*w*.

Disposed in the bore 40 adjacent the surface 40*s* is a stopper or closure means including a ball 50 and a seat ring 55. The ball 50 is rotatably movable to and from open (FIG. 3C) and closed (FIG. 2C) positions. As illustrated in FIGS. 10, 11, 12 and 13, the ball 50 includes an opening 51 therethrough for aligning with the inner bore 40 to enable flow of fluid through bore 40 in the open position and with the ball 50 rotating to the closed position to block flow of fluid through the inner bore 40. The ball 50 includes a spherical outer surface 52 having a pair of parallel flat portions 52*a* having eccentric recess 53 therein for a purpose to be described more fully hereinafter. The annular seat ring 55 has an arcuate mating surface 55*a* to seal with the spherical surface 52 for preventing flow of fluid around the ball 50.

A means for imparting movement to the stopper means or ball 50 includes an actuator means 60 disposed in the bore 40 of the housing 30. The actuator means includes a sleeve means 61 and a pivot means 62 mounted with the housing 30. The sleeve means 61 includes a piston portion 63, an upper portion 64, a middle portion 65, and a lower potion 66 as illustrated in FIGS. 2B and 2C. The actuator means 60 also includes spring means 63*a*, 64*a*, 65*a* and 66*a* to be described more fully hereinafter.

As illustrated in FIG. 2B, the upper piston portion 63 of the actuator sleeve means 61 is movable relative to both the housing 30 and the upper sleeve portion 64. The upper piston portion 63 is a sleeve having a larger outer diameter portion 63*b* adjacent the constant diameter portion 40*j* of the bore 40, a smaller diameter outer portion 63*c* located above the larger diameter portion 63*b* adjacent the constant diameter portion 40*h* of the bore 40. An annular recess 63*e* positioned on outer annular shoulder 63*d* connects the outer surfaces 63*d* and 63*c*. A smaller inner constant diameter surface 63*f* is connected to a larger constant diameter lower inner surface 64*g* by a tapered annular surface 63*h*. A lower beveled surface 63*i* and an upper surface 63*j* complete the surfaces of the sleeve 63. An O-ring 63*k* seals between the surface 40*h* of the housing and the smaller diameter outer surface 63*c*. An O-ring 63*m* seals between the surface 40*j* and the larger outer diameter surface 63*b* of the sleeve 63. A sliding ring spring keeper member 35 is disposed in the bore 40 between the sleeve means 61 and the housing 30. The keeper 35 is longitudinally movable along the surface 40*jb* of the bore 40 between the shoulders 40*jb* and 40*k* of the housing 30. The spring 63*a* is positioned between the lower shoulder 63*i* of the piston portion 63 and the keeper 35 for urging the piston portion 63 upwardly to the location illustrated in FIG. 2B. The piston 63 is longitudinally movable in the housing 30 between the position illustrated in FIG. 2 and the position illustrated in FIG. 4 collapsing the spring 63*a*, in a manner to be described more fully hereinafter.

Figure 3A:
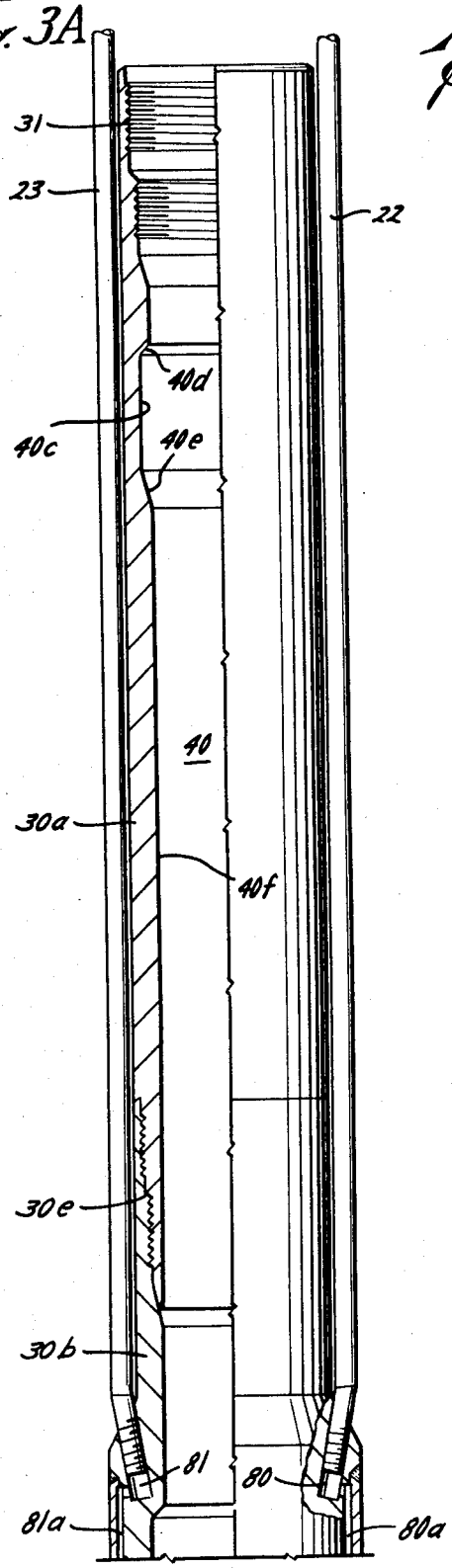
FIGS. 3A, 3B and 3C are views similar to FIGS. 2A, 2B and 2C, respectively, but showing the ball valve in the open position.
Figure 3B:
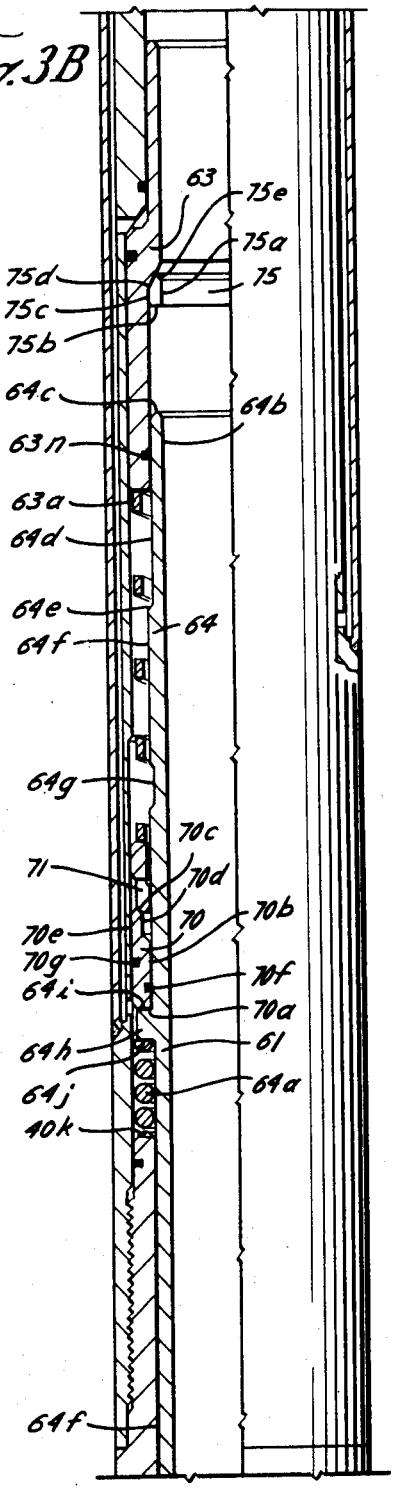

As illustrated in FIG. 3B, the upper sleeve portion 64 includes a constant diameter inner surface 64*b*, an upper end 64*c* having beveled edges, a smaller diameter outer surface 64*d*, an outer annular shoulder 64*e*, a larger constant diameter outer surface 64*f* having a recess 64*g* therein, an outwardly extending annular collar 64*h* having a flat upper surface 64*i* and a lower flat surface 64*j*. The spring 64*a* is positioned in the bore 40 between the shoulder 64*h* and the spring shoulder 40*k* of the housing 40 for urging the longitudinally movable sleeve 64 from the location illustrated in FIG. 3B upwardly to the location illustrated in FIG. 2B. An O-ring 63*n* seals between the outer surface 64*d* of the member 64 and the surface 63*g* of the piston portion 63.

Figure 3C:
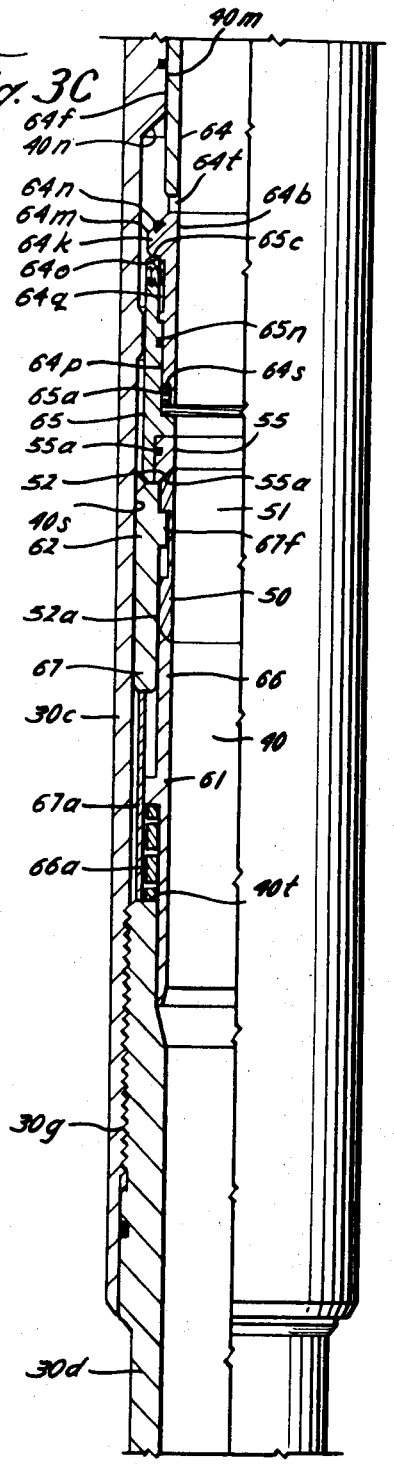

As illustrated in FIG. 3C, the upper portion 64 also includes an outer collar 64*k* with an upper annular tapered surface 64*m* having an O-ring 64*n* therein, a lower flat surface 64*o*, a larger diameter lower outer portion 64*p*, having a recess 64*q* therein , a lower smaller constant diameter outer portion 64*r*, and a stepped bottom surface 64*s* connecting with the inner surface 64*b*. A channel 64*t* extends through the sleeve 64 above the collar 64*k* for a purpose to be described more fully hereinafter.

As illustrated in FIG. 2C, the middle portion sleeve 65 is movable in the housing and includes a constant diameter outer surface 65*b*, an upper shoulder 65*c*, a larger constant diameter inner portion 65*d*, a spring shoulder 65*e*, an intermediate diameter inner portion 65*f*, a flat annular shoulder 65*g*, a constant diameter inner portion 65*h*, a flat lower surface 65*i*, an inner surface 65*j* and a bottom shoulder 65*k*. Threaded member 65*m* is secured to the sleeve 65 and extends inwardly into the recess 64*g* to connect the sleeve 64 and the sleeve 65 while permitting limited relative longitudinal movement. The seat ring 55 is mounted with the shoulders 65*e* and 65*g* of the sleeve 65. The spring 65*a* located between the surface 64*s* of the sleeve 64 and the shoulder 65*a* urges the sleeve 65 to move away from the sleeve 64 to maintain the ring 55 in sealing contact with the ball 50. An O-ring 65*n* seals the surface 65*i* to the sleeve 64. An O-ring 55*a* seals between the seat ring 55 and the sleeve 65. Sealing the sleeve 65 at 65*n* and 55*a*, enables the pressure in the bore 40 below the ball 50 to act in both directions on the sleeve 65 to balance and offset such fluid pressure and enable the small spring 65*a* to hold the seat ring 55 against the ball 50 even with great pressure in the bore 40. An outer larger diameter portion 65*o* serves as a guide and an upper stop for the sleeve 65 engaging the shoulder 40*r* of the housing 40 in the upper position.

As illustrated in FIG. 2C, the movable lower sleeve 66 includes a uniform diameter inner portion 66*b*, an annular tapered lower shoulder 66*c*, a uniform diameter outer portion 66*d*, an outer annular shoulder 66*e* having a flat lower surface 66*f*, a constant diameter upper outer portion 66*g* and an upper arcuate surface 66*h*. The shoulder 66*h* engages the spherical outer surface 52 of the ball 50. The spring 66*a* is positioned between the shoulder 40*t* of the housing 40 and the shoulder 66*f* of the lower sleeve 66 for urging the lower sleeve 66 to move upwardly.

The pivot means 67 is secured within the housing 40 against upwardly movement by an inwardly projecting member (not shown) threaded in the housing and extending into the pivot means 67 and a sleeve extension 67*a* engaging the housing shoulder 405 to prevent downward movement of the pivot means 67. As partially illustrated in FIG. 13, the pivot means 67 includes a split sleeve formed by a constant diameter inner surface 67*b*, upper and lower surfaces 67*c* and 67*d*, respectively, and a constant outer diameter surface 67*e* having the recess 67*g* therein. A circular pin 67*f* extends inwardly from the pivot means 67 within each of the eccentric slots 53 of the ball 50.

Figure 4:
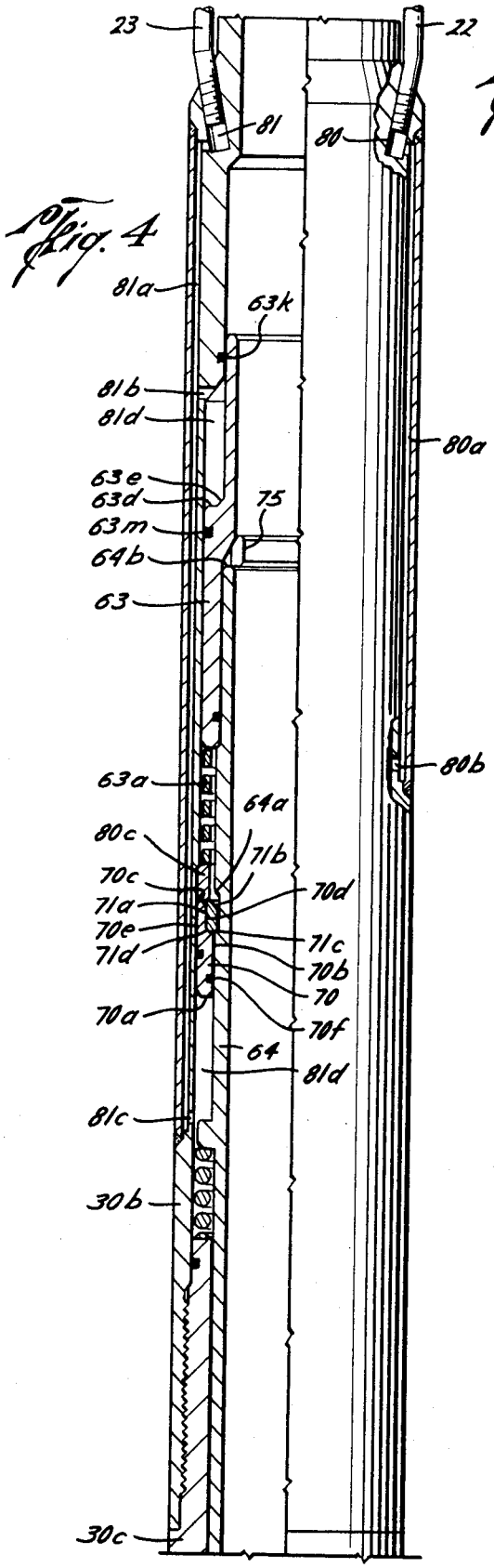
FIG. 4 is an elevation, partly in section, illustrating an intermediate portion of the apparatus for locking the ball valve in the open position of FIG. 3C.
Figure 5:
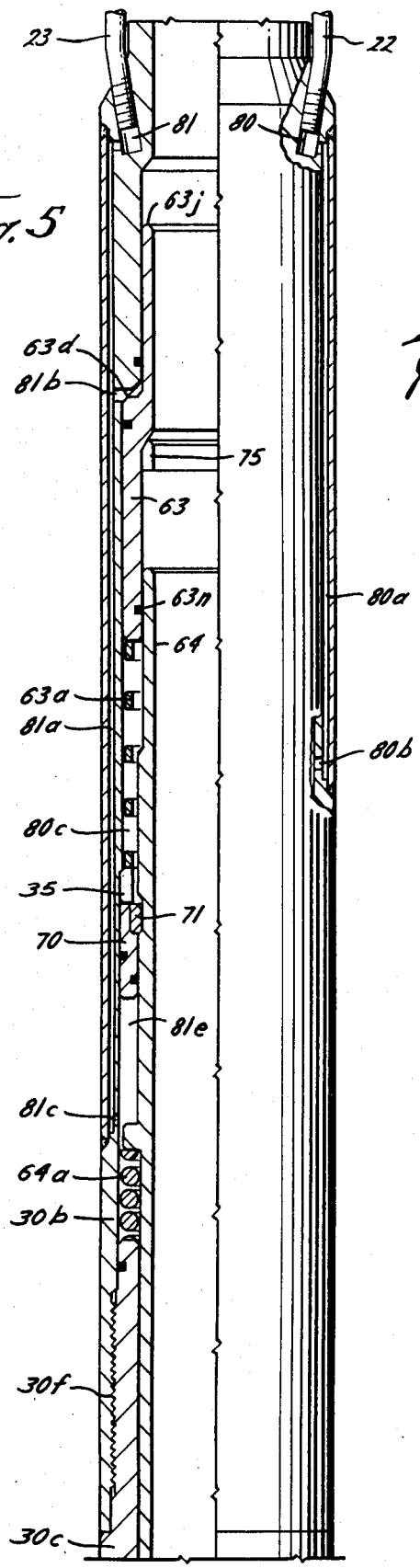
FIG. 5 is a view similar to FIG. 4, but illustrating the means for locking the ball valve open in another position.

A releasable locking means is disposed in the bore 40 of the housing 30 for mechanically locking the ball 50 in the open position as illustrated in FIGS. 4 and 5. The locking means includes the recess 64*g* of the sleeve 64, an annular piston latch means 70 and a ring detent member 71. The piston 70 is a longitudinally movable ring or sleeve member concentrically disposed between the sleeve 64 and the housing 40 having a flat lower surface 70*a*, a constant diameter inner surface 70*b*, a stepped upper surface 70*c* having an inner locking shoulder 70*d* and a constant diameter outer portion 70*e*. an O-ring 70*f* slidably seals the inner surface 70*b* of the piston 70 to the outer surface 64*g* of the sleeve 64. An O-ring 70*g* seals the piston 70 to the housing 30. The detent 71 is a snap split ring located above the latch 70 having a sufficient gap opening therein to enable the ring to constrict and move into the recess 64*g* of the sleeve 64 when aligned therewith. The detent ring includes a flat portion 71*a*, an upper tapered portion 71*b* and lower tapered portions 71*c* and 71*d* for purposes to be described more fully hereinafter. A means for releasing or unlocking the ball 50 is also provided which is to be described more fully hereinafter.

A positioning means 75 (FIG. 2B) is disposed in the inner bore of the tubular housing member 30 for positioning a flow control means 85 (FIG. 6A) for controlling the flow in the bore 40, as will be explained. The positioning means 75 includes a spring split ring 75 having a gap opening therein to enable the ring 75 to constrict and move into the bore 40. The ring 75 includes an inner diameter surface 75*a*, a flat lower edge 75*b*, a constant diameter outer portion 75*c*, a tapered annular outer portion 75*d* and an inwardly tapered inner portion 75*e*. In the expanded position illustrated in FIG. 2B, the bore of the ring 75 has the same diameter as the bore of the sleeve 64 enabling full bore flow through the tool. As illustrated in FIG. 4, the positioning ring 75 is moved into the bore 40 by piston portion 63 which is to be described more fully hereinafter.

The control fluid pressure means conduit 32 communicates with the control fluid opening 80 in the housing 30. The fluid control pressure is communicated through the opening 80 into a channel 30*a* to a port 80*b* and into an annular expansible chamber 80*c* within the inner bore 40 of the housing 30. The expansible chamber 80*c* is defined by the lower surface 63*i* of the piston portion 63, by a portion of the outer surfaces 64*c*, 64*d* and 64*e* of the upper sleeve portion 64, by the stepped surface 70*c* and the shoulder 70*d* of the piston member 70 and the surfaces 40*j*, 40*ja* and 40*jb* of the housing 30. The pressure of the fluid introduced into the chamber 80*c* through the control fluid conduit means 22 acts on shoulder 63*i* to move the piston portion 63 upwardly. Such pressure also acts downwardly on the stepped shoulder 70*c* of the latch member 70 to move the movable latch member 70 downwardly. The inner surface of the sliding keeper member 35 is spaced from the sleeve 64 for communicating the control fluid pressure to the latch member 70.

The second control fluid pressure means conduit 23 communicates with the opening 81 in the tubular member 30 and is communicated through a channel 81*a* to a port 81*b* and a port 81*c*. The port 81*b* communicates with an annular variable capacity chamber 81*d* formed by a portion of the outer surfaces 63*b* and 63*c* and the annular tapered shoulder 63*c* of the piston 63 and the annular tapered shoulder 40*i* and the inner surface 40*j* of the housing 30. Control fluid introduced into the chamber 81*d* exerts a force on the shoulder 63*d* to move the piston sleeve 63 downwardly for a purpose to be described more fully hereinafter. The control fluid is communicated through port 81*c* into a variable capacity chamber 81*e* defined by a portion of the inner surface 40*j* and the shoulder 40*k* of the housing 30, the outer surface 64*d* of the sleeve 64 and the surface 70*a* of the piston 70.

Figure 6A:
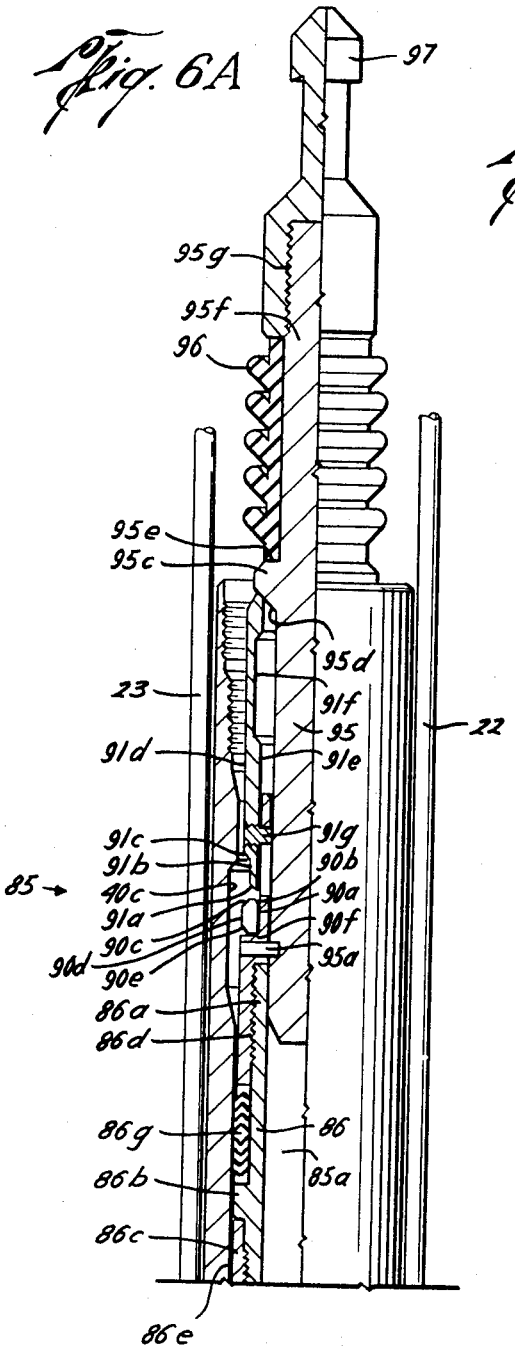
FIGS. 6A and 6B are elevations, partly in section, showing the upper and an intermediate portion of the apparatus of this invention, with a flow control assembly being pumped or otherwise moved downwardly into the apparatus.
Figure 6B:
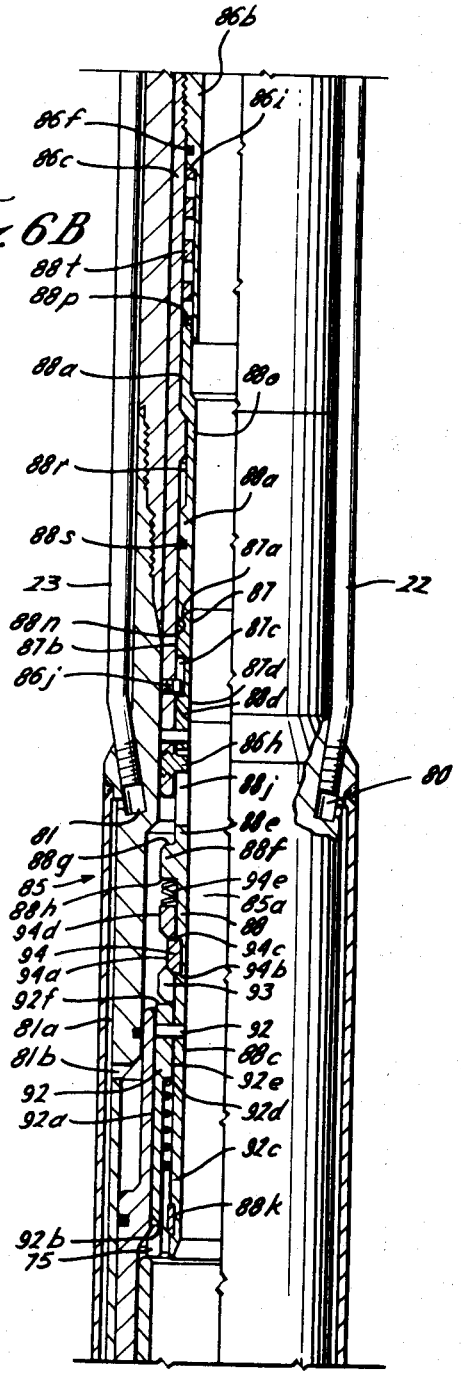

As illustrated in FIGS. 6A and 6B, a means for controlling the flow in the bore of the housing includes a flow control assembly generally designated 85 comprising a frame means 86, a plug means 87, a mover means 88 and a securing means generally designated 89.

The frame means 87 comprises a tubular member having a longitudinal bore 85*a* aligned and communicating with the bore 40 of the housing 30 and includes an upper sleeve portion 86*a*, a center sleeve portion 86*b* and a lower sleeve portion 86*c*. The center portion 86*b* is secured to the upper portion 86*a* by threads 86*d* while threads 86*e* secure the center portion 86*b* and the lower portion 86*c*. An O-ring 86*f* also seals between portions 86*b* and 86*c*. A packing 86*g* seals the middle portion 86*b* to the inner surface 40*f* of the housing 30 for directing all flow through the bore 40 through the bore 85*a* of the frame means 86.

The plug means 87 is disposed in the bore 85*a* of the frame means 86. The plug means 87 is a ball type member rotating to and from open and closed positions. The ball 87 includes a spherical outer surface 87*a* having a pair of flat opposite portions 87*b* with eccentric recesses 87*c* for a purpose to be described more fully hereinafter. The diameter of the ball 87 is the same as the outer diameter of the frame 86 or the inner diameter of the sleeve 61. The ball 87 also includes an inner bore 87*b* therethrough for permitting communication through the bore 85*a* of the frame 86 when the ball 87 in the aligned or open position illustrated in FIG. 6A. When the ball 87 rotates to the closed or transverse condition illustrated in FIG. 7A, the ball 87 blocks flow through the bore 85*a* of the frame means 85 and the bore 40 of the housing 30.

The mover means 88 for moving the plug means 87 to and from the open and closed positions includes a movable sleeve portion 88*a* above the ball 87 and a movable sleeve portion 88*b* below the ball 87. The lower sleeve portion 88*b* includes a constant diameter inner surface 88*c*, an upper surface 88*d* engaging the ball 87, an outside surface 88*e* having an outwardly extending collar 88*f* with upper and lower flat shoulders 88*g* and 88*h*, respectively, and an annular recess 88*i*. A plurality of longitudinally extending openings 88*j* extend through the sleeve 88*b*. Corresponding inwardly projecting fingers 86*h* secured to the frame 86 extend into the grooves 88*j* connecting the sleeve 88*b* and the frame 86, permitting relative longitudinal movement therebetween after shearing a shear pin 195.

The upper portion 88*a* of the actuator sleeve 88 includes a lower surface 88*n*, a stepped inner surface 88*o*, an upper shoulder 88*p*, and an outer surface 88*q* having a recess 88*r* therein. An inwardly projecting shoulder 86*i* of the frame 86 extends into the recess 88*r* for limiting the longitudinal movement of the upper sleeve portion 88*a* relative to the frame 86. An O-ring 88*s* seals between the outer surface 88*q* of the sleeve 88*a* and the inner surface of the frame 86. A spring 88*t* mounted between a shoulder 86*i* of the frame 86 and the shoulder 88*p* of the actuator sleeve 88 urges the sleeve 88*a* to move downwardly for a purpose to be described more fully hereinafter. The seating surface 88*n* engages the ball 87 for sealing between the upper actuator sleeve 88*a* and the ball 87.

Figure 7A:
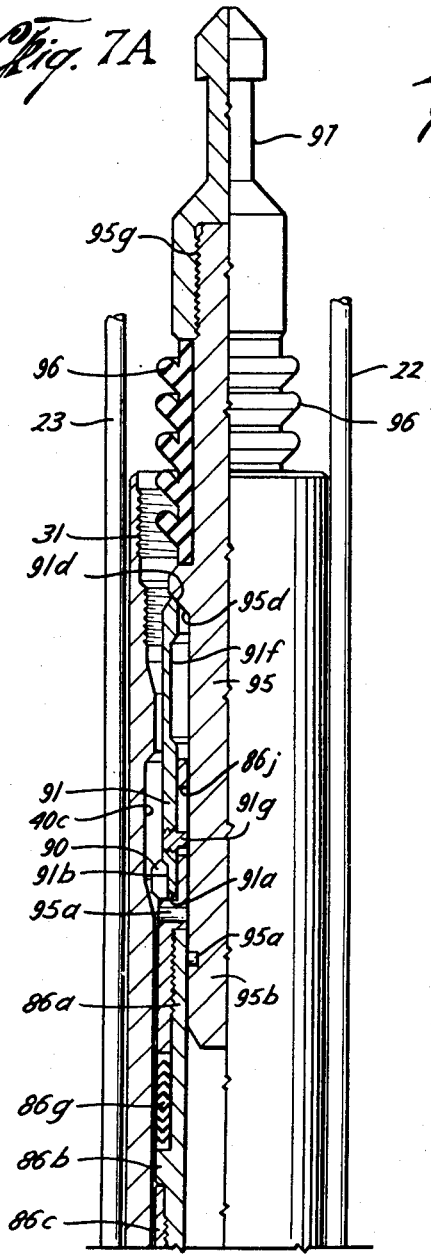
FIGS. 7A and 7B are views similar to FIGS. 6A and 6B, but showing the valve with the flow control assembly in the closed position.

The actuator means 88 also includes a pivot means for rotating the ball 87. The eccentric slots 87*c* within the flat surfaces 87*b* of the ball 87 receive corresponding inwardly extending members 86*j* threadably secured in the frame 86*c*. By threadedly securing the fingers 86*j* in the frame 86 the large diameter ball 87 may be placed in the frame 86*c* and the fingers 86*j* secured for ease of assembly. A downward movement of the sleeve 88*a* will cause the ball 87 to rotate about the members 86*j* to the open or aligned position illustrated in FIG. 6A. A upward movement of the sleeve 88*b* rotates the ball 86 around the eccentric extensions 86*j* to move the ball 87 to the transverse or closed position as illustrated in FIG. 7A.

As illustrated in FIG. 6 B, the securing means 89 comprises a expansible detent ring 90 and a latch sleeve 91 for securing the frame 86 in the bore 40 of the housing 30. The movable latch member 91 includes a outer tapered lower surface 91*a*, a shoulder surface 91*b*, a stop 91*c*, a annular upper shoulder 91*d*, and a constrant diameter inner surface 91*e* having a recess 91*f* therein. A plurality of inwardly extending projections 91*g* secured in the number 91 project within a corresponding plurality of longitudinal openings 86*j* in the frame member 86*a* for slidably securing the latch 91 to the frame 86 while permitting limited relative movement therebetween. The detent 91 is an expansible split ring concentrically mounted with the frame means 86 below the latch 91 and adapted for moving outwardly from the position illustrated in FIG. 6 B to the position illustrated in FIG. 7-B when aligned with the recess 40*c*. The split ring 91 includes a constant diameter inner surface 90*a*, a upper inner tapered shoulder 90*b*, an outer upper tapered portion 90*c*, a constant diameter portion 90*d*, a lower tapered outer portion 90*e*, and a lower flat portion 90*f*.

The tubular assembly 85 also includes a means for engaging the mover means 88 with the actuator means 61 for moving the ball 87 to and from the open and closed positions using pressure of the control fluid. The engaging means includes a lower sleeve 92, a detent ring 93, and a latching shoulder 94. The latching shoulder 94 is concentrically mounted with the sleeve 88*b*. The latching shoulder 94 includes a uniform diameter outer surface 95*a* and a tapered lower surface 94*b*, and a flat upper surface 94*c*. A slidable keeper 94*d* is mounted on the sleeve 88 and is urged downwardly by spring means 94*e*. The expansible detent ring 93 includes a uniform diameter inner surface 93*a*, an inward tapered upper surface 93*b*, and outer upper tapered surface 93*c*, a uniform diameter outer surface 93*d*, a lower outer tapered surface 93*e*, and a lower flat surface 93*f*. The sleeve 92 includes a constant diameter outer portion 92*a*, a tapered lower portion 92*b*, a small diameter inner surface 92*c*, an annular shoulder 92*d*, a larger diameter inner portion 92*e* and a flat upper shoulder 92*f*. The outer sleeve 92 is slidably secured to the actuator sleeve 88 by a snap ring 88*k* engaging the spring keeper 92*e*. A spring 92*f* is located between the keeper 92 and the shoulder 92*d* for urging the sleeve 92 upwardly. A shear pin 92*g* initially positions the sleeve 92 with respect to the sleeve 88, for a purpose to be described more fully hereinafter. The spring 92*f* urges the sleeve 92 upwardly when the shear pin 92*g* has been sheared.

As illustrated in FIG. 6A a running tool 95 is secured to the frame 86 by a shear pin 95*a* for installing the valve 85. The running tool 95 includes a lower tubular portion 95*b* into which shear pin 95*a* extends, a collar portion 95*c* having a lower annular tapered shoulder 95*d* above the latch 91, an upper flat shoulder 95*e* and upper tubular portion 95*f* having a threaded portion 95*g* adjacent the top. A rubber cup swab tool or plug 96 is mounted with the upper portion 95*f* between the shoulder 95*e* and a standard fishing neck 97. Both the rubber swab cup 96 and the fishing neck 97 are well known in the art.

Figure 9:
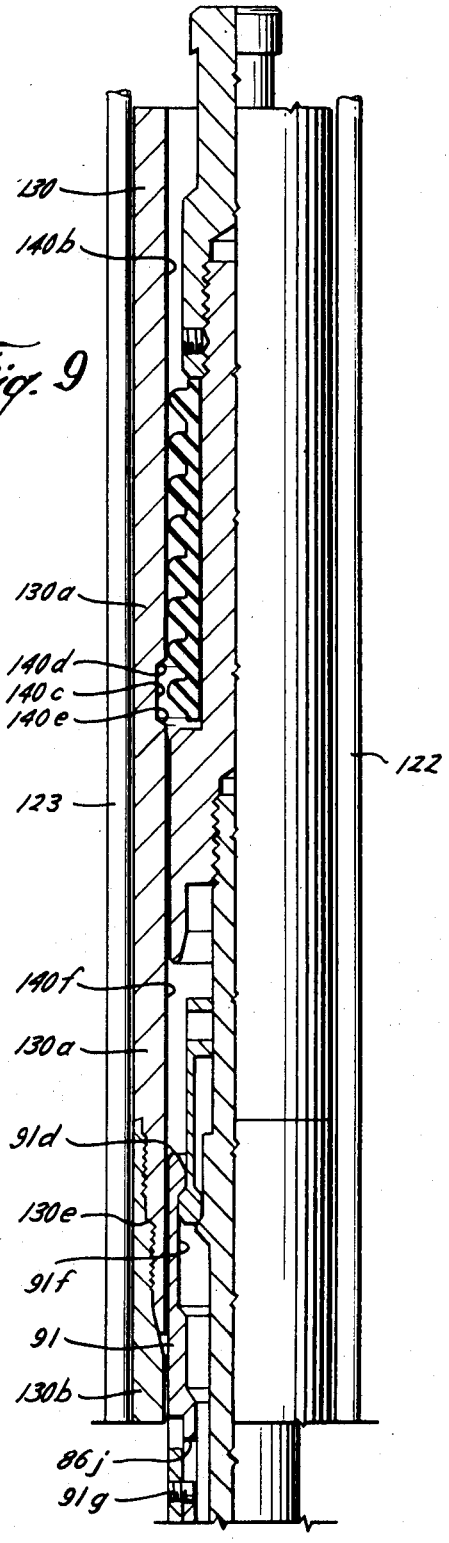
FIG. 9 is a view similar to FIGS. 6A and 7B, but showing the retrieval tool connected to the flow control assembly.

The means for controlling the flow in the bore also includes a bore plug pulling or retrieval tool 196. As illustrated in FIG. 9 the retrieval tool 196 includes a lower extension 196*a* having an annular tapered outer shoulder 196*b*, a upper portion 196*c* threadedly engaged with lower portion by threads 196*d*. A swab or plug 197 is mounted on the exterior of the upper portion 196*c* and is secured thereto by the fishing neck 198 threadedly engaging the portion 196*c* with threads at 196*e*. A collet member 211 is movably mounted on the exterior surface of the lower portion 196*a* of the retrieval tool 196. The collet 211 includes a slidable base 211*a*, a plurality of flexible arms 211*b* extending downwardly having enlarged heads 211*c*. The collet 211 is movably retained between shoulders 196*f* and 196*g*. The base shoulder 196*g* is spaced sufficiently from the shoulder 196*f* wherein the base 211*a* adjacent the shoulder 196*f* will permit the head 211*c* to be positioned above the shoulder 196*g* enabling the head 211*c* to move inwardly by flexing of the member 211*b* to provide clearance to the head 211*c* as the head 211*c* moves downwardly past the surface 91*e* and into the recess 91*f* of the latch member 91.

In the use and operation of the present invention, the tool 20 is connected in the tubing string T to position the tool 20 at the desired location in the well W below the surface S as illustrated in FIG. 1. The conduit 22 and the conduit 23 are connected and the tool 20 is lowered into the casing C as is well known in the art.

When the valve 20 is lowered in the well with the ball 50 in the transverse position, drilling fluid must be injected into the production tubing T above the ball 50 at the surfaces to prevent the collapse of the production tubing T above the ball 50. Filling of the tubing T above the ball 50 is not required if the tool 20 is lowered into the well W with the ball 50 in the locked open condition which is to be described more fully hereinafter.

As illustrated in FIGS. 2*b* and 2*c*, when the pressures in the conduit 23 and the conduit 22 are equal, the piston sleeve 63 has equal pressures acting upwardly on the lower surface 63*i* and downwardly on the shoulder 63*d*. Since the effective areas on which the pressures act are equal, the urging on the sleeve 63 is offsetting and the spring 63*a* will urge the sleeve 63 to move upwardly to the position illustrated. Since the effective areas of the surfaces 70*a* and 70*c* of the piston are also equal, the urging of the pressure acting on the lower surface 70*a* is the same as the urging of the pressure acting on the upper step surface 70*c* of the latch member 70. With this offsetting pressure urging on the latch member 70, the spring 64*a* will urge the sleeve 64 to move upwardly and move the shoulder 64*i* of the outwardly extending collar 64*h* into engagement with the lower shoulder 70*a* of the latch 70. The latch 70 will move upward until the upper portion of surface 70*c* engages the detent ring 71 which is prevented from moving upward by the keeper 35 engaging the shoulder 40*ja*. The sleeve 64 in the upper position engages the tapered annular shoulder 40*n* of the housing 40 with annular tapered surface 64*m* and is sealed thereto by O-ring 64*n*. The spring 65*a* urges the sleeve 65 downwardly for maintaining the seat ring 55 seating surface 55*a* against the ball 52. The lower portion of the actuator sleeve is urged upward by the spring 66*a* for rotating the ball to the transverse position blocking flow through the inner bore 40 of the housing 30.

As can be seen by this arrangement, the valve is "fail-safe" in that a loss of pressure in the fluid control lines 22 and 23 would enable the spring 66*a* to move the ball 50 to the closed position blocking flow up the bore 40 of the housing 30.

In normal operation, the tool 20 is controlled by introducing fluid under pressure through the conduit 22 and venting through the conduit 23. The control fluid pressure is communicated from the conduit 22 through the channel 80*a* and the port 80*b* into the expansible chamber 80*c*. The pressure of the control fluid in the chamber 80*c* urges upwardly on the shoulder 63*i* of the upper portion 63 of the valve actuator sleeve 61. This urging assists spring 63*a* in urging the sleeve 63 upwardly. The pressure in the chamber 80*c* also acts on step surface 70*c* for urging the latch member 70 to move downwardly. The upper shoulder 64*g* of collar 64*f* engages the lower surface 70*a* of the downwardly moving latch 70 wherein the pressure in the chamber 80*c* must overcome the urging of the spring 64*a* before the latch 70 and engaged valve actuator sleeve 64 continue to move downwardly.

Figure 10:
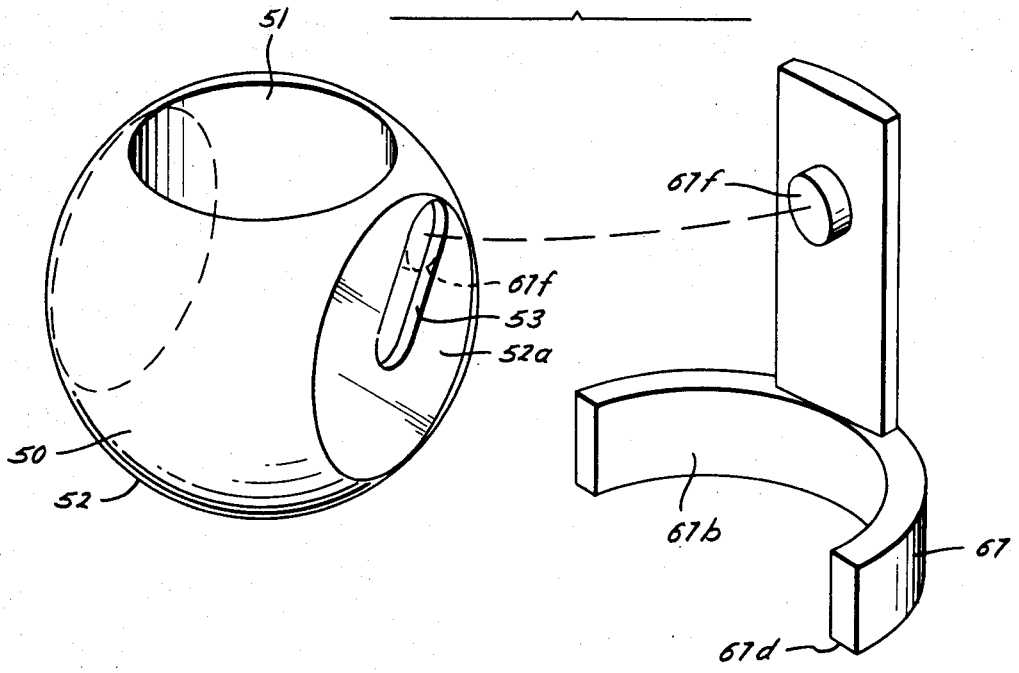
FIGS. 10, 11 and 12 are elevations, partially in section, showing the open, intermediate and closed relationship, respectively, of the ball valve and pivot members.
Figure 11:
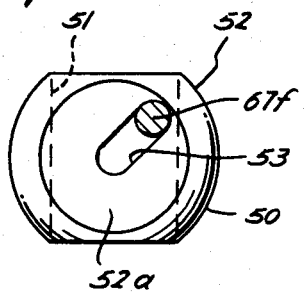
Figure 12:
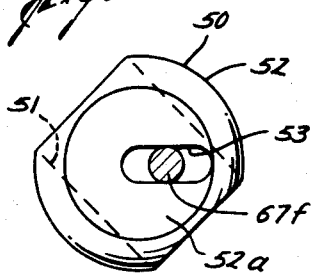
Figure 13:
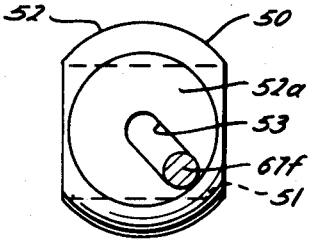
FIG. 13 is an exploded view, partially in section, showing assembly of the ball and pivot means.

The initial downward movement of the sleeve 64 collapses the spring 65*a* and moves the shoulder 64*k* away from the shoulder 40*n* of the housing 40 enabling communication of fluid in the bore 40 from below the ball 50 through the port 64*t* into the bore 40 above the ball 50 while the ball 50 remains in the closed position. The equalizing port 64*t* permits the pressure above and below the ball 50 to equalize before commencing to rotate open the ball 50. Equalizing the pressure differential across the ball 50 will reduce the velocity of the initial flow across the seating surface 52*a* of the ball 52 and seat ring 55*a* as the ball 52 commences to rotate open. As the latch 70 and engaged sleeve 64 continue to move downwardly the lower surface 64*o* of the collar 64*k* engages the shoulder 65*c* to move the sleeve 65 downwardly. The ball 50 is urged downwardly by the engaged seat 55*a* mounted with the sleeve portion 65 wherein the ball 50 rotates around the inward extending eccentric members 67*f* extending within the slots 53 of the ball 50 to rotate the ball 50, as illustrated in FIGS. 10, 11 and 12. As the ball 50 rotates to the aligned position, illustrated in FIG. 3C it moves downwardly moving the engaged lower portion of the sleeve 66 downwardly and overcoming the upward urging of the spring 66*a*. The vented conduit 23 serves as a means for receiving the fluid in the chamber 81*e* as the piston 70 moves downwardly wherein the operation of the ball 50 is independent of the pressure in the bore 40 of the housing 30.

The downward momentum of the sleeve 64 impacting on the engaged sleeve 65 and ball 50 assists in overcoming the inertia of the sleeve 65 and ball 50 and reduces the fluid pressure required to initiate rotation of the ball 50.

To return the ball 50 to the transverse or closed position the pressure of the fluid in the conduit 22 is vented at the surface enabling the fluid to flow out of the expansible chamber 80*c*. The strongest spring 66*a* urging on the lower portion 66 of the valve actuator sleeve 61 first moves the ball 50 and the sleeves 64, 65 and 66 upwardly. The movement of the ball 50 rotates the ball 50 about the members 67*f* of the pivot means 67 to rotate the ball 50 to the transverse position as illustrated in FIG. 2-C. The ball 50 is rotated to the transverse position before the equalizing port 64*t* is sealed. This reduces the velocity of flow through the opening 51 as the ball rotates closed. As the pressure of the fluid in the chamber 80*c* continues to decrease, the spring 64*a* will urge the sleeve 64 to move to the upper position and seat shoulder 64*m* against the shoulder 40*n* of the housing 30 for sealing with O-ring 64*n* to block flow through the equalizing port 64*t*. The spring 65*a* urges the sleeve 65 downwardly as the spring 64*a* moves the sleeve 64 upwardly to maintain the seal between the valve seat 55*a* and the surface 52 of the ball 50.

A means for locking the ball 50 in the open position is provided should it be necessary to run a tool down the bore 21 of the production tubing T below the valve 20. Also, the ball 50 may be locked open when the tubing T is lowered into the well W in order that the drilling fluid within the well W may flow through the bore 40 of the housing 30 to fill the bore 21 above the valve 20 and prevent a collapse of the production tubing T. To lock the ball 50 open, the conduit 22 is vented and the control fluid pressure in the conduit 23 is increased. This pressure is communicated into the valve 20 at opening 81 and communicated through channel 81*a* to the ports 81*b* and 81*c*. The pressure is communicated through port 81*b* and into the expansible chamber 81*d* partially defined by the shoulder 63*d*. The recess 63*c* serves as a manifold to communicate the fluid pressure over the entire surface of the shoulder 63*d* when the upper portion 63 of the valve actuator sleeve 61 is in the upper position, illustrated in FIG. 2B. The pressure urging on the shoulder 63*d* urges the sleeve 63 to move downwardly to the position illustrated in FIG. 4. The downwardly movement of the sleeve 63 engages the surface 63*i* with the annular shoulder 64*e* of the sleeve 64 to move the sleeve 64 downwardly. The fluid pressure communicated through port 81*c* into the expansible chamber 81*c* partially defined by lower shoulder 70*a* of the latch member 70 urges the latch member 70 to move upwardly.

The downwardly movement imparted to the sleeve 64 by the sleeve 63 operates in the same manner as when the sleeve 64 was moved downward by the latch 70 to rotate the ball 50 to the open position. When the ball 50 moves the open position the recess 64*e* is aligned with the detent 71 enabling the detent 71 to move into the recess 64*e*. This movement enables the control fluid pressure urging on the shoulder 70*a* to move the latch member 70 upwardly to lock the detent 71 in the recess 64*e*, as illustrated in FIG. 4. With the detent 71 locked in the recess 64*e* the spring 66*a* is unable to move the ball 50 upwardly for rotation to the closed position, when the fluid pressure in the conduit 23 is reduced.

As illustrated in FIG. 4 the downwardly movement of the sleeve 63 by the urging of the pressure of the control fluid means in the conduit 23 engages the lower surface 75*b* of the positioning means 75 with the upper shoulder 64*b* of the sleeve 64 to force the ring 75 to move inwardly to constrict the bore 40 of the housing 30.

As illustrated in FIG. 5, a reduction of the control fluid pressure after locking leaves the ball 50 locked in the open position by detent 71 and latch 70, but the spring 63*a* urges the upper sleeve 63 to move upwardly, enabling the ring 75 to expand along the tapered shoulder 63*g* to a position where it no longer constricts the bore 40 of the housing 30.

To unlock the ball 50 the control fluid pressure in conduit 23 is vented and the control fluid pressure in the conduit 22 is increased. The increased pressure is communicated into the expansible chamber 80*c* where it urges on the shoulder 70*c* to move the latch member 70 downwardly. The movement of latch member 70 unlocks the detent 71 and enables the detent 71 to move out of the recess 64*e* for unlocking the ball 50. A subsequent reduction of the control fluid pressure in the conduit 22 enables the spring 66*a* to urge the sleeve 66 upwardly to rotate the ball 50 to the closed position.

Should sand or other abrasives flowing with the hydrocarbon through the bore 40 of the tool 20 damage the seat 55*a* or the spherical surface 52 of the ball 50 wherein the seal between the ball 50 and the seat 55 is unable to block the flow of fluid through the bore 40, a means to control the flow in the bore 40 may be located in the bore 40 by moving into the bore through the bore 21 of the production tubing T.

To position the flow control assembly 85 in the bore 40 of the housing 30, the ball 50 is locked in the open position by detent 71 and latch member 70 using control fluid pressure in the conduit 23. The pressure in the conduit 23 also urges the positioning ring 75 to move inwardly to constrict the bore 40 of the housing 30. The assembly 85 is connected to the installation tool 95 by shear pin 95*a*. The connected members are inserted into the bore 21 of production tubing T at the surfaces with the tool 95 above the assembly 85. The pressure in the bore 21 above the tool 95 is then increased by use of a pump or other pressure generating means to urge the assembly 85 and tool 95 to move down the bore 21, as illustrated in FIGS. 6A and 6B. A wire line may be attached to the tool 95 as the tool 95 and connected assembly move down the bore. The ball 87 is maintained in the open position by shear pin 195.

When the latching sleeve 92 enages the constricting ring 75, the pressure in the bore 21 shears the shear pin 95*a* between the installation tool 95 and the tubular assembly 85, enabling the shoulder 95*d* of the installation tool 95 engaged with the shoulder 91*d* of the latch 91 to move the latch 91 downwardly relative to the frame 86. The tapered lower shoulder 91*a* of the latch member 91 engages the correspondingly tapered shoulder 90*b* of the detent 90 for expanding the detent outwardly into the recess 40*c* of the housing 30. The latch sleeve 91 continues to move downwardly until the detent 90 is seated on the shoulder 91*b* of the latch member as illustrated in FIG. 7A. When the detent 90 is seated on the latch 91, the tapered shoulder 90*b* engages the corresponding tapered shoulder 91*c* of the latch member 91. The flat surface 90*f* of the detent 90 engages the frame 86*a* for transmitting the downward force of pressure above the tool 95 to the frame 86.

The downward urging force on the frame 86 is opposed by positioning means 75 engaging the sleeve 92 secured to the valve actuator 88 by the shear pin 92*g*.

Figure 7B:
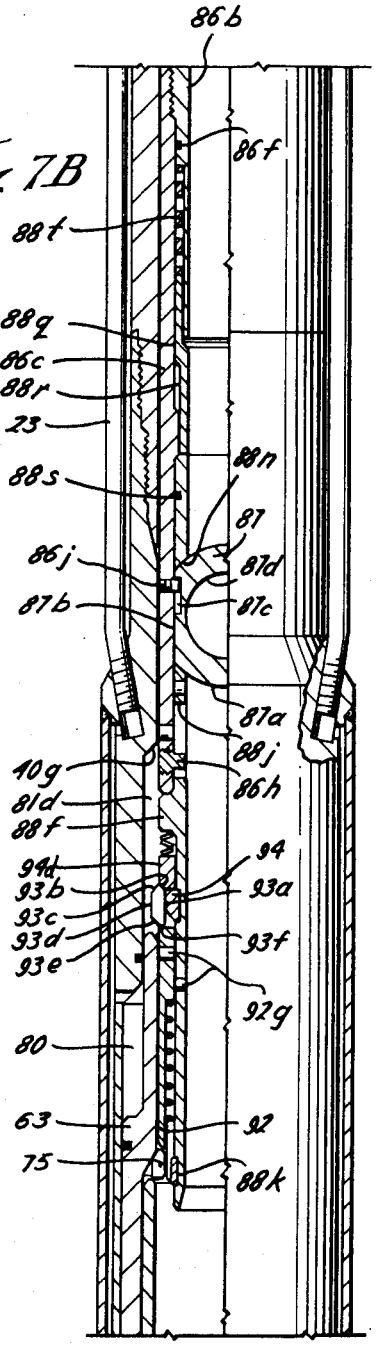
Figure 8A:
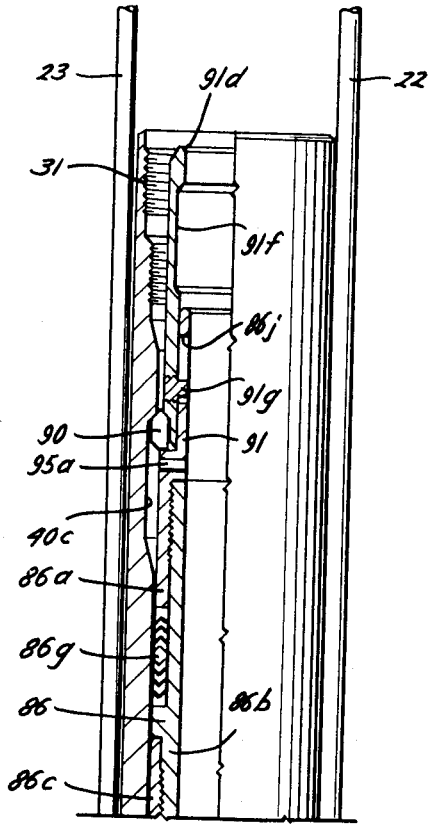
FIGS. 8A and 8B are views similar to FIGS. 7A and 7B, respectively, but with a portion of the flow control assembly removed.
Figure 8B:
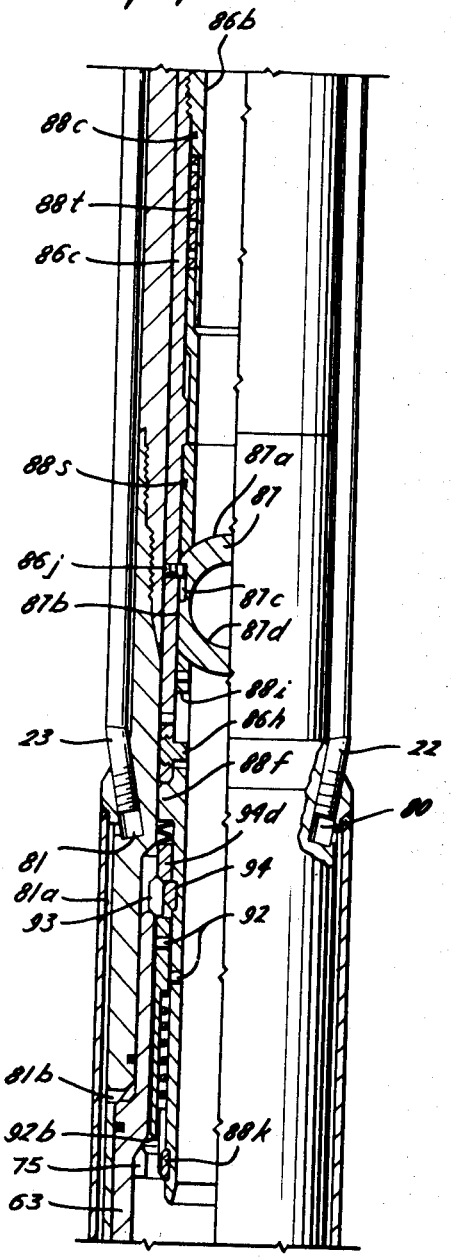

The downward force shears the pin 92g between the sleeve 88 and the latch 92. The engaging detent 93 is then wedged outwardly into a recess in the housing 30 formed by the surface 40h between the annular shoulder 40g and the upper end 63j of the sleeve 63 by the tapered shoulder 94b as the keeper 94 moves downwardly relative to the detent 93. The detent 93 moves to seat on the surface 94a of the keeper 94 for securing the detent 93 within the recess, as illustrated in FIg. 7B. The pressure in the bore 21 above the tool 95 is then reduced and formation pressure flowing upwardly through the bore 21 urging on the tool 95 moves the tool 95 upwardly to the surface S. The fishing neck 97 is used to recover the tool 95 if the tool 95 should become lodged in the bore 21 of the production tubing T. After the tool 95 is retrieved the control fluid pressure in conduit 23 is reduced, moving the tubular assembly to the position illustrated in FIG. 8A and 8B. and shearing the shear pin 195.

Figure 14:
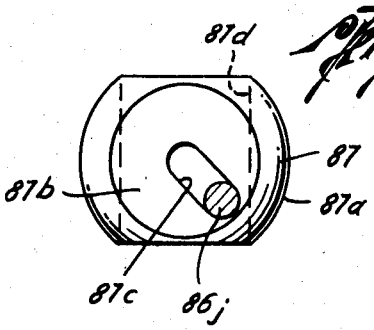
FIGS. 14 and 15 are elevations, partially in section, showing the open and closed relationship, respectively, of the flow control assembly ball valve and pivot members.
Figure 15:
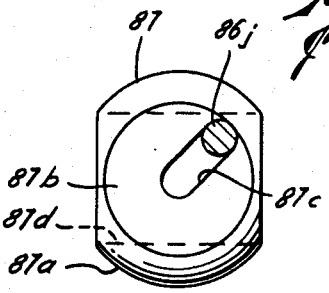

The operation of the assembly 85 is controlled by movement of the sleeve 63. The control fluid pressure urging on the shoulder 63d moves the sleeve 63 downwardly enabling the spring 88t to urge the sleeve 88 to move downwardly rotating the ball 87 around the eccentric members 86j to the open position as illustrated in FIG. 6B. Reduction of the pressure in the conduit 23 enables the spring 63a to urge the upper sleeve 63 to move upwardly engaging the detent 93 and moving the sleeve 88 upwardly for overcoming the downwardly urging of the spring 88t and rotating the ball 87 to the closed position illustrated in FIG. 7B. With this arrangement the means for controlling the flow in the bore 40 of the housing 30 will still block flow through the bore 40 if control fluid pressure is lost. The relationship of the ball 87 and the finger 86j is illustrated in greater detail in the lower or open position in FIG. 14 and in the upper or closed position in FIG. 15. By venting the conduit 22 a means for receiving the fluid displaced by movement of the sleeve 63 is provided wherein the operation of the ball 87 is independent of the pressure in the bore 40 of the housing 30. The ball 50 remains in the locked open position during oeration of the assembly 85.

Should the assembly 85 malfunction or otherwise be rendered unable to block the flow through the bore 40 of the housing 30, the assembly 85 may be retrieved by pumping a retrieval tool 196 down the bore 21. Before pumping the retrieval tool 196 down the bore 21 of the production tubing T to retrieve the tubular assembly 185, the ball 87 is rotated to the opened position, as illustrated in FIG. 9 by increasing the pressure of the control fluid in the conduit 23. As the retrieval tool 196 moves downwardly into the well tool 20 the collet head 211c engages the upper latch member shoulder 91d for moving the collet 211c upwardly adjacent to shoulder 196f wherein the collet head 211c will move inwardly to permit the retrieval tool 196 to continue to move downwardly. When aligned with the recess 91f of the member 91 the head 211c will move outwardly for connecting the retrieval tool 196 to the tubular assembly 85. The pressure in the bore 21 above the tool 96 is then reduced to enable the formation pressure to urge the tool 196 and connected assembly 85 to move upwardly, but a wire line may be used to recover the assembly 85 if the formation pressure is not sufficient. As the tool 196 moves up it pulls the latch member 91 upwardly from under the detent 90 enabling the detent 90 to move out of the recess 40c as illustrated in FIG. 6A. The member 91g then engages the upper edge of the slot 86k to move the frame 86 upwardly. The upward mpvement of the frame 86 enables the member 86h to engage the upper edge of the slot 88j and move the connected sleeve 88 upwardly. The spring 88g is free to maintain the ball 87 in the open position enabling formation pressure to communicate through the base 87d to urge upwardly on the tool 196 to move the tool 196 and connected assembly 85 upwardly. As the sleeve 88 moves upwardly, the shoulder 93c of the detent 93 engages the shoulder 40g of the housing 30 which forces the detent 93 off of the shoulder 94a. As the detent moves off of the member 94 it moves inwardly to the position illustrated in FIG. 6A enabling the tool 96 and tubular assembly 85 to move upwardly in the bore 21 to the surface S. A replacement tubular assembly 85 may then be pumped down the bore of the tubing 21 in the manner set out above.

The foregoing disclosure and description of the invention are illustrative and explanatory thereof, and various changes in the size, shape, and materials as well as in the details of the illustrated construction may be made without departing from the spirit of the invention.

What is claimed is:

1. A method of operating a well producing hydrocarbons from a subsurface formation, including the steps of:

controlling flow in the bore of a well production tubing by a safety valve connected in the production tubing at a subsurface location in the well by controlling the control fluid pressure communicated to the safety valve from the surface;

placing a flow control assembly in the bore of the production tubing at the wellhead;

moving the flow control assembly through the bore of the production tubing to the safety valve;

securing the flow control assembly in the bore of the production tubing adjacent the safety valve; and, operating the flow control assembly with the control fluid communicated to the safety valve for controlling flow through the production tubing with the flow control assembly.

2. The method as set forth in claim 1, including the step of:

moving a portion of the subsurface safety valve into the bore for positioning the flow control assembly for operably securing in the bore of the production tubing.

3. The method as set forth in claim 1, including the step of:

retrieving the flow control assembly through the bore of the production tubing from adjacent the subsurface safety valve to the wellhead when desired.

4. A method of operating a well including:

installing a flow conductor in said well for conducting fluids from a producing formation therein to the surface;

controlling flow through said flow conductor by a subsurface safety valve in said flow conductor controlled by control fluid from the surface in response to predetermined conditions;

moving said subsurface safety valve to open position independently of said control fluid from the surface;

locking said valve in such open position for performing well servicing operations through an open valve; and providing a supplemental valve at a subsurface location in the flow conductor for control of fluid flow through the first valve while said first valve is held in the open position.

5. The method as set forth in claim 4, including:

operating the supplemental valve with control fluid from the surface to the first subsurface valve for controlling flow through said flow conductor.

6. A method of operably installing a remotely controlled flow control assembly in a well for controlling flow of well fluids through the bore of a well tubing at a desired subsurface location disposed below the wellhead assembly and adjacent a surface controlled safety valve, including the steps of:

placing the flow control assembly in the bore of a well tubing at a location remote from the subsurface safety valve;

moving the flow control assembly through the bore of the well tubing to the desired subsurface location adjacent the safety valve for securing with the well tubing;

securing the flow control assembly in the bore of the well tubing at the desired subsurface location adjacent the safety valve for controlling flow through the well tubing;

transmitting a control command independently of the well tubing to the safety valve for controlling operation of the flow control assembly; and operating the flow control assembly in response to the control command transmitted to the subsurface safety valve for controlling flow through the bore of the well tubing at the desired subsurface location.

7. The method as set forth in claim 6, wherein the step of operating further includes the step of:

opening the flow control assembly in response to the transmitted control command for enabling flow through the bore of the well tubing.

8. A method of operating a flow control assembly operably mounted in a safety valve connected in a production tubing at a subsurface location in a well, including the steps of:

operating the flow control assembly for controlling flow through the safety valve and the bore of the production tubing;

inserting a retrieval tool in the bore of the production tubing;

moving the retrieval tool through the bore of the production tubing to the safety valve for connecting with the flow control assembly;

releasing the flow control assembly from adjacent the safety valve; and moving the retrieving tool and connected flow control assembly through the bore of the production tubing from the subsurface safety valve for removal from the bore of the production tubing.

* * * * *